US006373231B1

(12) United States Patent
Lacey et al.

(10) Patent No.: US 6,373,231 B1
(45) Date of Patent: Apr. 16, 2002

(54) VOLTAGE REGULATOR

(75) Inventors: Timothy M. Lacey, Bedford, NH (US); Satish Saripella, Starkville, MS (US)

(73) Assignee: Cypress Semiconductor Corp., San Jose, CA (US)

( * ) Notice: Subject to any disclaimer, the term of this patent is extended or adjusted under 35 U.S.C. 154(b) by 0 days.

(21) Appl. No.: 09/730,315

(22) Filed: Dec. 5, 2000

(51) Int. Cl.[7] ..... G05F 1/40
(52) U.S. Cl. ..... 323/268
(58) Field of Search ..... 323/265, 266, 323/268, 270, 271, 273, 275, 282, 285, 312, 313

(56) References Cited

U.S. PATENT DOCUMENTS 4,689,733 A * 8/1987 Guth et al. ..... 363/51
5,570,043 A 10/1996 Churchill ..... 326/81
5,635,872 A * 6/1997 Zimmerman ..... 330/128
5,666,069 A 9/1997 Gibbs ..... 326/81
5,691,654 A 11/1997 Green et al. ..... 326/80
5,867,013 A 2/1999 Yu ..... 323/314
5,929,692 A * 7/1999 Carsten ..... 327/531
6,025,701 A * 2/2000 Weinhold ..... 323/207
6,094,095 A 7/2000 Murray et al. ..... 327/589
6,105,097 A 8/2000 Larky et al. ..... 710/129
6,118,676 A * 9/2000 Divan et al. ..... 363/34
6,144,580 A 11/2000 Murray ..... 365/185.01
6,157,178 A 12/2000 Montanari ..... 323/273

* cited by examiner

*Primary Examiner*—Matthew Nguyen
(74) *Attorney, Agent, or Firm*—Suiter & Associates PC

(57) ABSTRACT

A voltage regulator includes a static regulator that provides a static regulated supply output as a reference input to a dynamic regulator to provide a regulated supply voltage. In one embodiment, multiple dynamic regulators are connected to the static regulated supply output of the static regulator. The one or more dynamic regulators dynamically detect when the regulated supply voltage is loaded below a predetermined reference level, and provide extra current in response to prevent the regulated supply voltage from drooping. Since the static regulator is capable of handling large average currents, the dynamic regulator circuit can be smaller than a typical dynamic regulator for an equivalent load. Furthermore, since the dynamic regulator provides transient current requirements, the size of the static regulator may be likewise smaller in size than a typical static regulator for an equivalent load.

20 Claims, 4 Drawing Sheets

VOLTAGE REGULATOR

BACKGROUND

The present invention relates generally to regulated power supply devices, and in particular to voltage regulators.

Regulated power supply devices are utilized to provide a controlled voltage or current to a load in accordance with desired regulation characteristics. In general terms, there are two types of regulator circuits, linear static regulators and switching dynamic regulators. A static regulator typically provides a controlled output in response to slower transient loads. A dynamic regulator provides a controlled output based upon faster varying load characteristics. The design choice of using either a static regulator or a dynamic regulator is based upon the application in which the regulator is intended to be utilized. A static regulator is typically utilized where slow transient currents that would load the regulator are possible. A dynamic regulator is typically utilized where fast transient current values are possible.

SUMMARY

The present invention is directed to a voltage regulator that combines regulation techniques of both static regulators and dynamic regulators in which a static regulator portion of the voltage regulator provides a static regulated output, and a dynamic regulator portion of the voltage regulator provides a dynamic regulated output. In one embodiment of the invention, a dynamic regulator portion is provided with the output of a static regulator for controlling the output of the dynamic regulator portion of the voltage regulator.

In one embodiment, the invention includes a means for providing a static regulated output based upon a reference, and means for providing a regulated output based upon the static regulated output as an input thereto. In another embodiment, the invention includes a static regulator for providing a static regulated output based upon a reference, and a subcircuit for providing a regulated output based upon the static regulated output. In a particular embodiment of the invention, the subcircuit includes a dynamic regulator, and in another particular embodiment of the invention, the subcircuit includes a boost circuit. In a further embodiment, the invention includes a static regulator having a static regulator output, and a dynamic regulator having a regulated output wherein the static regulator output of said static regulator is coupled to a reference input of the dynamic regulator. In one particular embodiment, a voltage regulator of the present invention is provided on a semiconductor circuit for providing a regulated supply to other circuitry also disposed on the semiconductor, for example a programmable logic device, and which optionally includes static core circuitry as a static regulator load, and switching core circuitry as a dynamic regulator load. These and other embodiments are contemplated by the invention, which is not intended to be limited to any particular embodiment or embodiments described herein.

BRIEF DESCRIPTION OF THE DRAWINGS

The numerous advantages of the present invention may be better understood by those skilled in the art by reference to the accompanying figures in which.

DETAILED DESCRIPTION

Reference will now be made in detail to one or more embodiments of the invention, an example of which is illustrated in the accompanying drawings.

Figure 1:
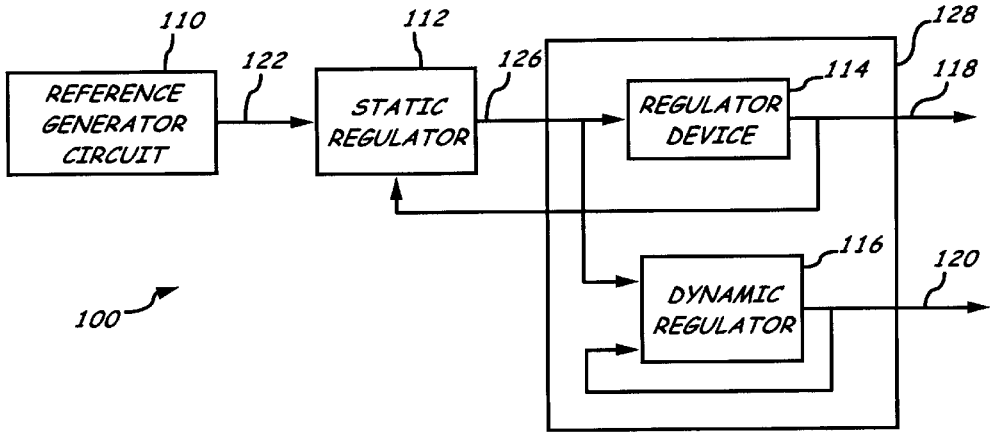
FIG. 1 is a block diagram of a voltage regulator in accordance with the present invention.

Referring now to FIG. 1, a block diagram of a voltage regulator in accordance with the present invention will be discussed. Voltage regulator 100 in one embodiment includes a reference generator circuit 110 for providing a reference 122 to static regulator 112. In one particular embodiment of the invention, reference 122 is a fixed voltage. A fixed voltage for reference 122 of reference generator circuit 110 may be provided, for example, by a Zener diode or a bandgap reference. Based upon reference 122 provided by reference generator circuit 110, static regulator 112 provides a regulator bias reference 126 to regulator device 114, which in turn provides a regulated supply output 118 to a load device or circuit (not shown). Since regulated supply output 118 is based upon static regulator 112, regulated supply output 118 is a static regulated supply output. The regulator bias reference 126 of static regulator 112 is further provided to dynamic regulator 116 as a reference input to dynamic regulator 116. Dynamic regulator 116 provides a regulated supply output 120 based upon regulator bias reference 126 provided by static regulator 112. Dynamic regulator 116 also receives a reference signal as an input, which is regulated supply output 120 fed back as an input thereto to provide regulated supply output 120. Since regulated supply output 120 is based upon dynamic regulator 116, regulated supply output 120 is a dynamic regulated supply output. Regulator device 114 and dynamic regulator 116 together comprise subcircuit 128.

Figure 2:
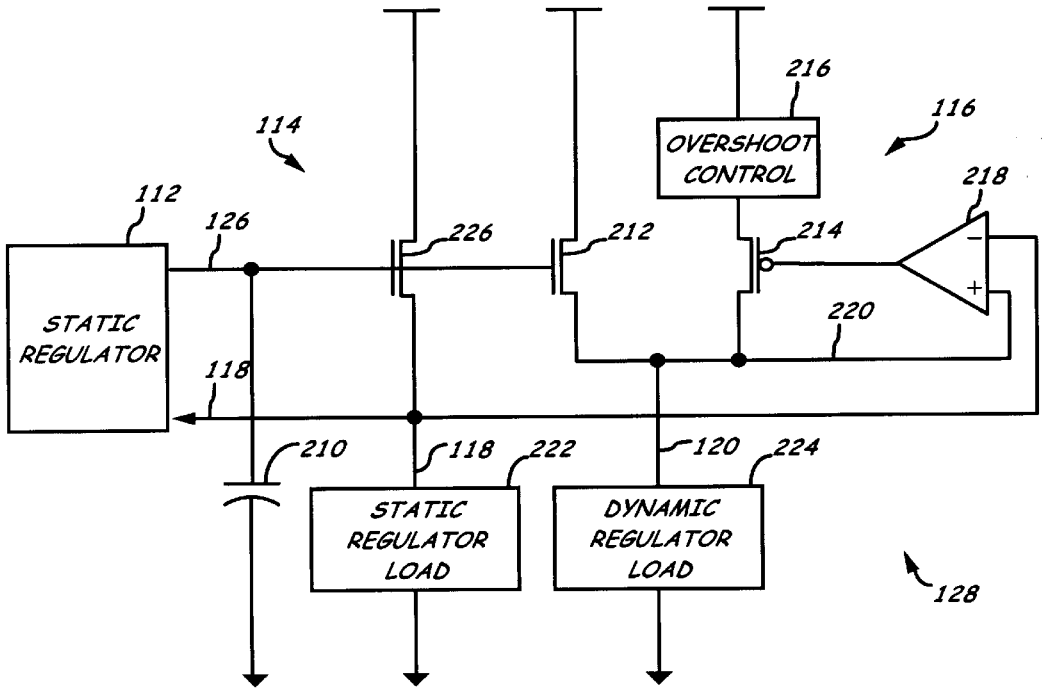
FIG. 2 is a schematic diagram of a subcircuit of a voltage regulator in accordance with the present invention.

Referring now to FIG. 2, a schematic diagram of a subcircuit of a voltage regulator in accordance with the present invention will be discussed. Subcircuit 128 includes regulator device 114 of static regulator 112 and dynamic regulator 116. Subcircuit 128 receives regulator bias reference 126 from static regulator 112, and presents regulated supply output 118 as a reference signal to static regulator 112. Regulator bias reference 126 is applied to regulator device 226, which in one embodiment is an n-channel metal oxide semiconductor (NMOS) transistor wherein regulator bias reference 126 is applied to the gate of the NMOS transistor of regulator device 226 as shown in FIG. 2. A capacitor 210 is optionally disposed in parallel with the gate of the NMOS transistor of regulator device 114. Regulated supply output 118 of regulator device 226 is applied to a static regulator load 222 that is suitable for receiving a static regulated supply, for example static core circuitry of a programmable logic device.

Dynamic regulator 116 in one embodiment likewise includes an NMOS transistor 212 that receives regulator bias reference 126 at the gate thereof. A p-channel metal oxide semiconductor (PMOS) transistor 214 is coupled with NMOS transistor 212 in parallel. Dynamic regulator 116 further includes a comparator 218 receiving regulated supply output 118 as an input, and also receiving a reference signal from a source node 220 of NMOS transistor 212 and PMOS transistor 214 as an input. The output of comparator 218 is provided to the gate of PMOS transistor 214 for dynamic regulation of supply output 120. An overshoot control circuit 216 is connected in series with the source of PMOS transistor 214. A dynamic regulator load 224 that is suitable for receiving a dynamic regulated output receives regulated supply output 120, which is coupled to source node 220. Dynamic regulator load 224 may be, for example, switching core circuitry of a programmable logic device.

Figure 3:
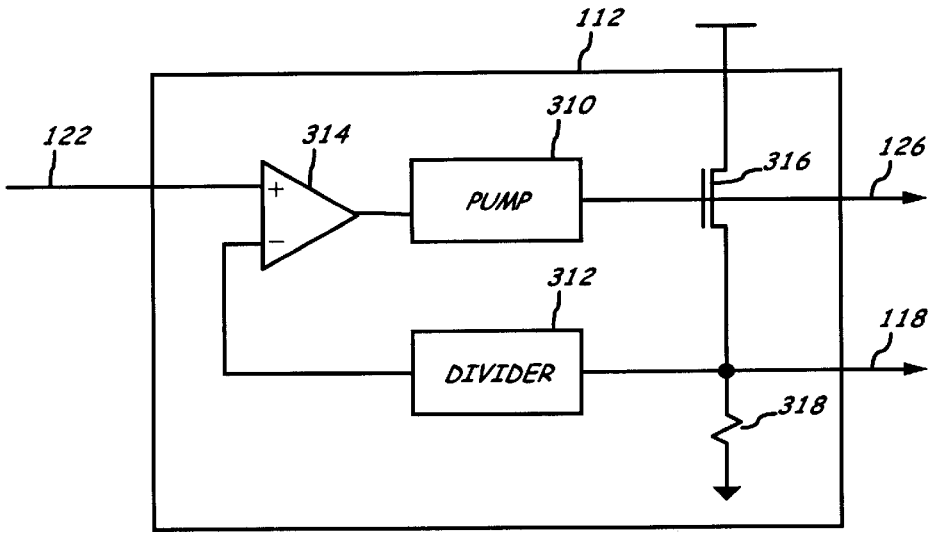
FIG. 3 is a schematic diagram of a static regulator in accordance with the present invention.

Referring now to FIG. 3, one embodiment of a static regulator component of a voltage regulator in accordance with the present invention will be discussed. Static regulator 112 receives a reference 122 from reference generator circuit 110. Reference 122 is applied as an input to a comparator 314, the output of which is applied to a pump circuit 310. The output of pump circuit 310 is applied to an NMOS transistor 316 at the gate thereof, and which is also provided as an output of static regulator 112 as regulator bias reference 126. A resistor 318 is coupled in series with NMOS transistor 316 at the source thereof to provide regulated supply output 118, which is provided as an output of static regulator 112 to subcircuit 128. Regulated supply output 118 is also provided as a feedback signal from the source of NMOS transistor 316 passed through a divider circuit 312, the output of which is provided as an input to comparator 314.

Figure 4:
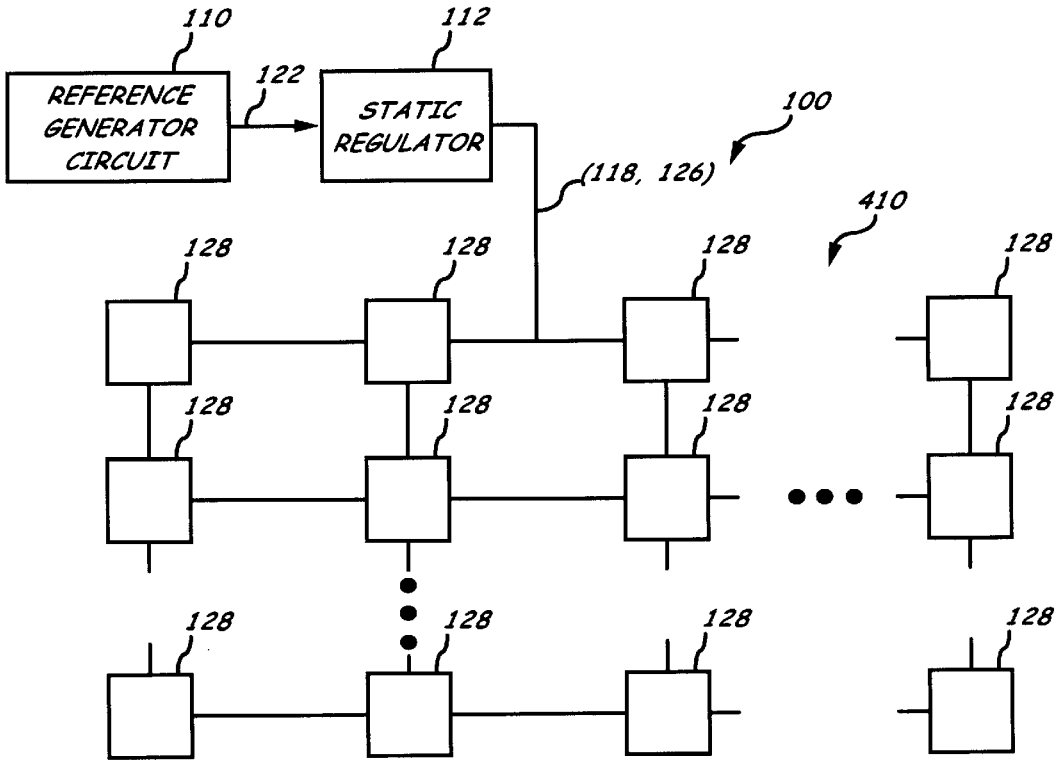
FIG. 4 is a block diagram of a voltage regulator in accordance with the present invention in which an array of subcircuits is coupled to a static regulator.

Referring now to FIG. 4, one embodiment of a voltage regulator in accordance with the present invention will be discussed. In the embodiment shown in FIG. 4, voltage regulator 100 comprises reference generator circuit 110 providing a reference 122 to static regulator 112. Static regulator 112 provides regulated supply output 118 as a reference signal, and regulator bias reference 126 to each subcircuit 128 in an array 410 of subcircuits 128. In one embodiment, array 410 of subcircuits 128 comprises M rows of subcircuits 128 coupled with N columns of subcircuits 128. In one embodiment, M may range from zero to infinity, an in particular may be one more, and likewise N may range from zero to infinity, and in particular may be one or more. In the embodiment shown in FIG. 4, voltage regulator 100 uses static regulator 112 and subcircuit 128 to maintain two regulated supply voltages. The first regulated supply voltage, regulated supply output 118, is used to supply circuitry of static regulated load 222 that, for example, does not require a current load during speed critical modes of operation. The second regulated supply, regulated supply output 120, is used for other types of circuitry of dynamic regulator load 224, for example other than static circuitry. Array 410 comprises multiple subcircuits 128 that include smaller dynamic regulators 116 for the second regulated supply, regulated supply output 120. Dynamic regulators 116 of the subcircuits 128 function as boost circuits, such as shown in FIG. 2, that dynamically detect when the regulated supply output 120 is loaded below regulated supply output 118, and then provide extra current to prevent regulated supply voltage 120 from drooping, i.e., falling to too low of a level. In one particular embodiment, because static regulator 112 and regulator device 114 handle larger values of average current, dynamic regulator 116 needs not be as large as would be typically required for an equivalent load, and thereby reduces or eliminates one or more disadvantages of using a sole dynamic regulator. Since dynamic regulator 116 is capable of handling instantaneous current requirements, static regulator 112 and regulator device 114 likewise need not be as large as would be typically required for an equivalent load.

Figure 5A:
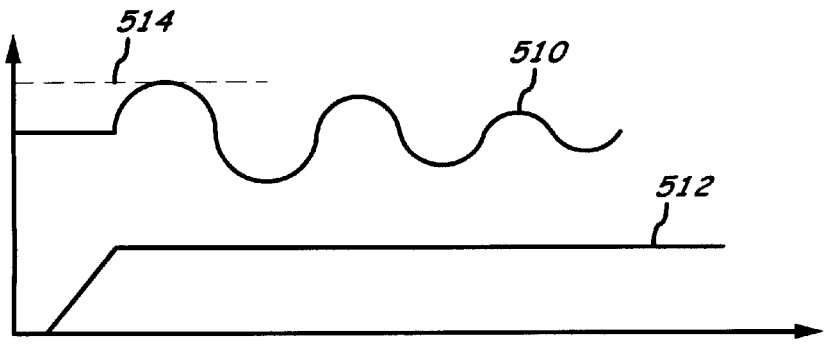
FIGS. 5A, 5B, and 5C are plots of the respective outputs of a static regulator, a dynamic regulator, and a voltage regulator in accordance with the present invention.
Figure 5B:
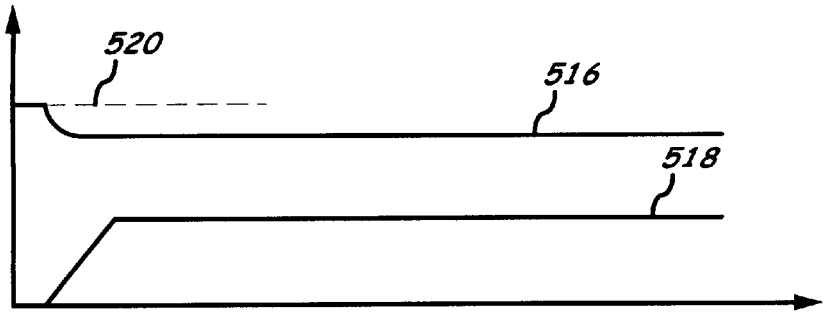
Figure 5C:
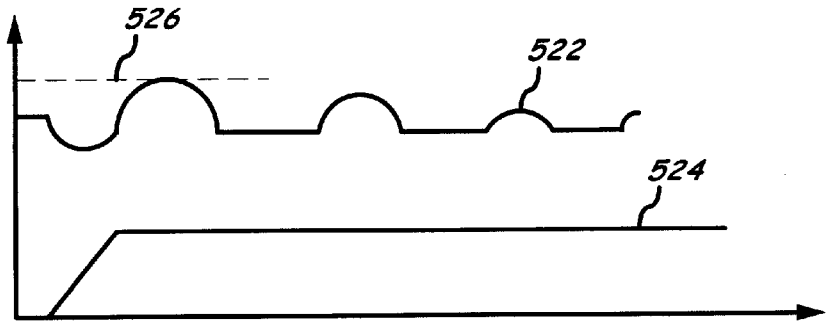

Referring now to FIGS. 5A, 5B, and 5C, plots of the regulator outputs in accordance with the present invention will be discussed. In FIG. 5A, the voltage output 510 and the current output 512 with respect to time for a typical dynamic regulator are shown. The voltage output 510 can vary over time while being maintained below a maximum value 514. In FIG. 5B, the voltage output 516 and the current output 518 with respect to time of a typical static regulator are shown. The voltage output 516 does not vary as drastically as with a dynamic regulator, and is maintained below a maximum value 520. In FIG. 5C, the voltage output 522 and the current output 524 with respect to time of voltage regulator 100 in accordance with the present invention are shown. The voltage output 522 exhibits characteristics of both a static regulator in that there is no drooping of the output voltage, and of a dynamic regulator in that the voltage may be increased, or boosted to maintain a higher average voltage, while remaining below maximum value 526.

Figure 6:
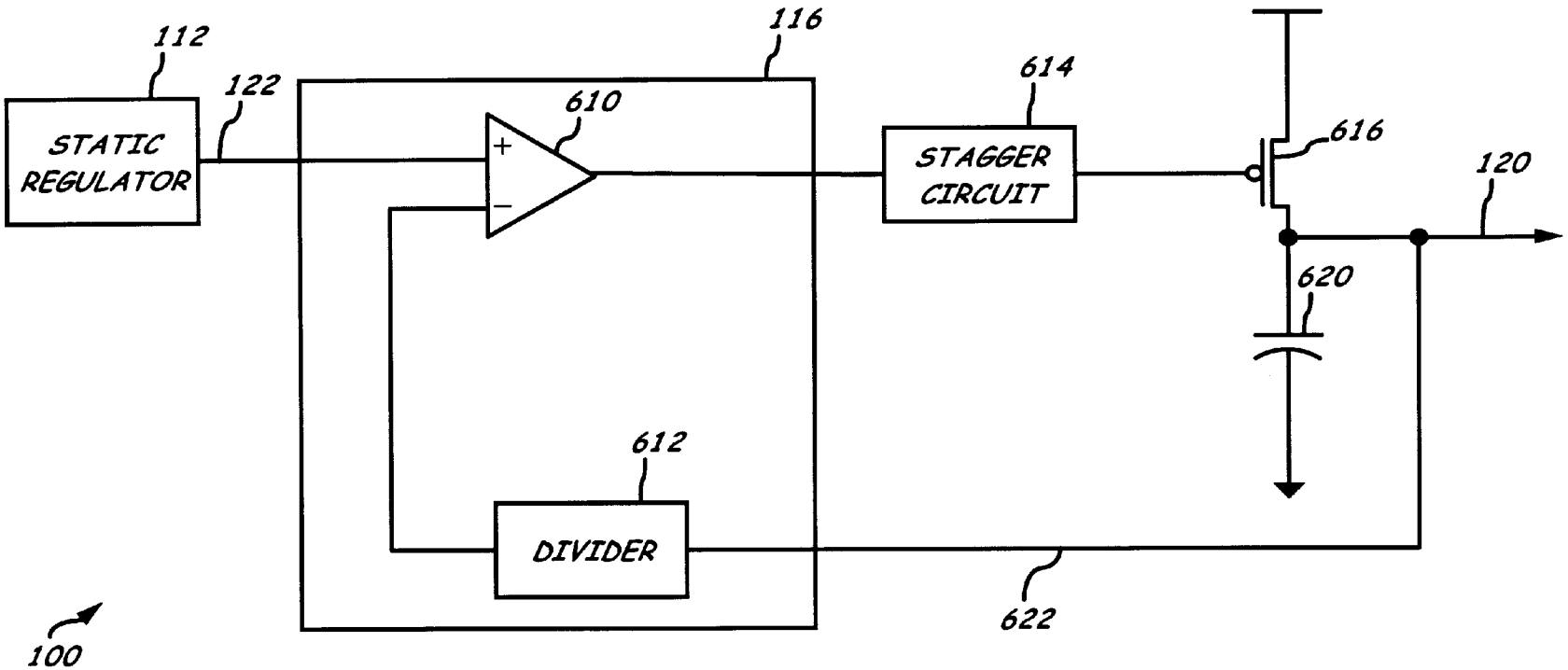
FIG. 6 is a block diagram of a voltage regulator in accordance with the present invention showing an alternative embodiment of a dynamic regulator.

Referring now to FIG. 6, a block diagram of a voltage regulator in accordance with the present invention showing an alternative dynamic regulator will be discussed. Regulator 100 includes a static regulator 112 providing a static regulated supply output 122 to dynamic regulator 116 as a reference input to dynamic regulator 116. Dynamic regulator 116 includes a comparator 610 receiving static regulated supply output 122 as an input. Comparator 610 also receives a reference signal 622 from regulated output 120 optionally scaled through divider 612 as an input to comparator 610. The output of comparator 116 is provided to a stagger circuit 614, the output of which is provided to an input of a regulator device 616. In one embodiment of the invention as shown in FIG. 6, regulator device 616 is a PMOS transistor receiving the output of stagger circuit 614 applied to the gate of the regulator device 616. Regulated output 120 is tapped off of the drain of PMOS 616, which is also fed back to dynamic regulator 116 as reference signal 622. Capacitor 620 is optionally provided across regulated output 120. Other alternative configurations of dynamic regulator 116 receiving static regulated output 122 of static regulator 112 may be utilized in accordance with the present invention, which need not be limited to the particular configurations shown and described herein. Regulated output 120 is similar to outputs 510 and 512 of FIG. 5A, and in one particular embodiment exhibits the characteristic of both a static regulated output and a dynamic regulated output when utilized, for example, with an NMOS parallel device in accordance with the present invention as shown in FIG. 2 so that regulated output 120 is similar to outputs 522 and 524 shown in FIG. 5C.

Although the invention has been described with a certain degree of particularity, it should be recognized that elements thereof may be altered by persons skilled in the art without departing from the spirit and scope of the invention, and without providing substantial change thereto. For example, several different alternative circuit configurations of static regulator 112 and of dynamic regulator 116 may be implemented to provide the same function of voltage regulator 100. In one embodiment, voltage regulator 100 is not coupled to a static regulator load, but is used mainly for providing a dynamic regulated load in accordance with the invention, for example, as shown in FIG. 5C. In an alternative embodiment, dynamic regulator 116 is provided with an offset that may be used to cause dynamic regulator 116 to be activated at a higher or a lower threshold. Furthermore, although particular transistor technology is discussed in the specification and shown in the drawing figures, the invention need not be limited to the particular technologies shown. For example, any one or more of transistors 114, 212, 226, 316, and 616 could be substituted with an alternative transistor technology such as bias-junction transistors (BJTs), without departing from the scope of the invention and without providing substantial change thereto.

It is believed that the voltage regulator of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. An apparatus, comprising:

means for providing a static regulated output based upon a reference; and means for providing a regulated output based upon the static regulated output as a reference input to said regulated output providing means.

2. An apparatus as claimed in claim 1, the regulated output being capable of exhibiting characteristics of a static regulated output and a dynamic regulated output.

3. An apparatus as claimed in claim 1, further comprising at least one or more means for providing a regulated output based upon the static regulated output.

4. An apparatus as claimed in claim 1, said means for providing a regulated output including a boost circuit.

5. An apparatus as claimed in claim 1, said means for providing a regulated output including means for limiting overshoot of the regulated output.

6. An apparatus as claimed in claim 1, said means for providing a regulated output being capable of providing a static regulated supply to a first load, and being further capable of providing a dynamic regulated supply to a second load.

7. An apparatus as claimed in claim 1, said static regulated output providing means including an NMOS device, and said regulated output providing means including a PMOS device.

8. An apparatus, comprising:

a static regulator for providing a static regulated output based upon a reference; and a subcircuit for providing a regulated output based upon the static regulated output as a reference input to said subcircuit.

9. An apparatus as claimed in claim 8, the regulated output being capable of exhibiting characteristics of a static regulated output and a dynamic regulated output.

10. An apparatus as claimed in claim 8, further comprising at least one or more subcircuits for providing a regulated output based upon the static regulated output.

11. An apparatus as claimed in claim 8, said subcircuit including a boost circuit.

12. An apparatus as claimed in claim 8, said subcircuit including an overshoot control circuit for limiting overshoot of the regulated output.

13. An apparatus as claimed in claim 8, said subcircuit being capable of providing a static regulated supply to a first load, and being further capable of providing a dynamic regulated supply to a second load.

14. An apparatus as claimed in claim 8, said static regulator including an NMOS device, and said subcircuit including a PMOS device.

15. An apparatus as claimed in claim 8, said subcircuit including a dynamic regulator.

16. An apparatus, comprising:

a static regulator having a static regulator output; and a dynamic regulator having a regulated output, the static regulator output of said static regulator being coupled to said dynamic regulator a reference input.

17. An apparatus as claimed in claim 16, the regulated output of said dynamic regulator being capable of exhibiting characteristics of a static regulated output and a dynamic regulated output.

18. An apparatus as claimed in claim 16, said dynamic regulator comprising a boost circuit.

19. An apparatus as claimed in claim 16, said dynamic regulator being smaller in size than a typical dynamic regulator for an equivalent load.

20. An apparatus as claimed in claim 16, said static regulator being smaller in size than a typical static regulator for an equivalent load.

* * * * *